US006665966B1

(12) United States Patent
Beck

(10) Patent No.: US 6,665,966 B1
(45) Date of Patent: Dec. 23, 2003

(54) REMINDER APPARATUS FOR A BRAND OF A PRODUCT

(75) Inventor: Kathleen A. Beck, Shawnee, KS (US)

(73) Assignee: Beck & Associates, Inc., Shawnee, KS (US)

( * ) Notice: Subject to any disclaimer, the term of this patent is extended or adjusted under 35 U.S.C. 154(b) by 0 days.

(21) Appl. No.: 10/068,821

(22) Filed: Feb. 6, 2002

(51) Int. Cl.[7] ..... G09F 13/04
(52) U.S. Cl. ..... 40/564; 40/600
(58) Field of Search ..... 40/564, 455, 600, 40/906, 124.02, 124.03, 442

(56) References Cited

U.S. PATENT DOCUMENTS

| | | | | | |
|---|---|---|---|---|---|
| 4,223,801 | A | * | 9/1980 | Carlson | 221/3 |
| 4,361,408 | A | * | 11/1982 | Wirtschafter | 368/10 |
| 6,075,755 | A | * | 6/2000 | Zarchan | 368/10 |
| 6,271,631 | B1 | * | 8/2001 | Burrows | 315/169.3 |
| 6,314,384 | B1 | * | 11/2001 | Goetz | 702/177 |
| 6,357,746 | B1 | * | 3/2002 | Sadowski | 273/148 R |
| 6,367,180 | B2 | * | 4/2002 | Weiss et al. | 40/564 |
| 2002/0105804 | A1 | * | 8/2002 | Li | 362/253 |

OTHER PUBLICATIONS

Copy of web page of ALR Technologies, Inc., p. 1 of 1, at www.alrt.com/vetprod.html for Veterinary Medication Reminders—Product Information, believed to have been known by others prior to the invention of the invention disclosed and claimed in the present application.

Copy of web pages of ALR Technologies, Inc., pp. 1 & 2 of 2, at www.alrt.com/vetprog.html for Veterinary Medication Reminders—Programming Directions, believed to have been known by others prior to the invention of the invention disclosed and claimed in the present application.

* cited by examiner

*Primary Examiner*—Gary Hoge
(74) *Attorney, Agent, or Firm*—Erickson & Klegpas, LLC

(57) ABSTRACT

An activity reminder for reminding a person to engage in an activity associated with a particular brand includes a lens with indicia associated with the brand formed therein. The lens is mounted on a housing in front of a light source. The light source is activated by a signal from a timer circuit to illuminate the indicia after a selected interval of time. A reset button is mounted on the housing and connected to the timer to allow a user to reset the timer circuit and turn off the light source.

12 Claims, 1 Drawing Sheet

REMINDER APPARATUS FOR A BRAND OF A PRODUCT

BACKGROUND OF THE INVENTION

The present invention relates to timer devices and, more particularly, to an electronic reminder device to remind a person to engage in an activity at a particular time such as taking or dispensing medication.

Devices have been developed to remind persons to take medications on a particular time schedule. Such devices can be quite sophisticated, tracking multiple medication schedules. Some medication reminder devices are programmed by a physician or a pharmacist, while others can be set up by the patient. Some devices incorporate compliance tracking features in which the patient presses a "taken" button to store a time stamp when a medication is taken.

Many medication reminder devices are geared toward prescriptions involving taking a medication multiple times within a day, mostly for a single medication and usually for a limited number of days. As such, it is relatively easy for the patient to remember what medicines the reminder are associated with.

Some actions are regularly taken at relatively long time intervals, such as the use of certain medications. For example, certain kinds of heartworm medications for dogs are given at monthly intervals. There are scheduling software products for computers and "personal digital assistants" (PDA's) which could be used as a reminder for such an activity engaged in at a long interval schedule. There is also a known device for reminding a pet owner to administer a medication on a monthly cycle, sold as the ALRT Pet Reminder from ALR Technologies, Inc. of Bellingham, Wash. (www.alrt.com). The ALR device is programmable, has light and an audible alert which are activated at a preset interval, and is provided in a shape, such as a dog paw shape or a bone shape. When the reminder device activates, the pet owner is alerted that some activity related to the pet should occur, but is not informed exactly what activity is called for.

SUMMARY OF THE INVENTION

The present invention provides a reminder that is associated with a particular brand of a product or a specific entity or organization. The reminder is adapted to remind a user to engage in an activity, such as use of a product associated with the reminder, when the device activates.

The reminder includes a logo plate or lens which is mounted on a housing in front of a display device or light source such as a light emitting diode. The logo plate includes indicia formed in or printed on the logo plate. The indicia is preferably formed on the logo plate such that portions of the indicia or the adjacent surface are either transparent or translucent to highlight the indicia when the light source is activated. The light source is activated by an illumination signal which is generated by a timer circuit at a preselected interval.

A reset button is provided on the housing and connected to the timer circuit. When pushed or selected, the reset button resets the timer circuit for the preselected interval and deactivates the light source. An audio alarm or sounder may also be connected to the timer circuit, and activated and deactivated in the same manner as the light source. Batteries are preferably used to provide power to the reminder.

Magnets are also preferably mounted to a rear surface of the housing to facilitate mounting of the reminder on a metal surface such as a refrigerator or metal cabinet.

Objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
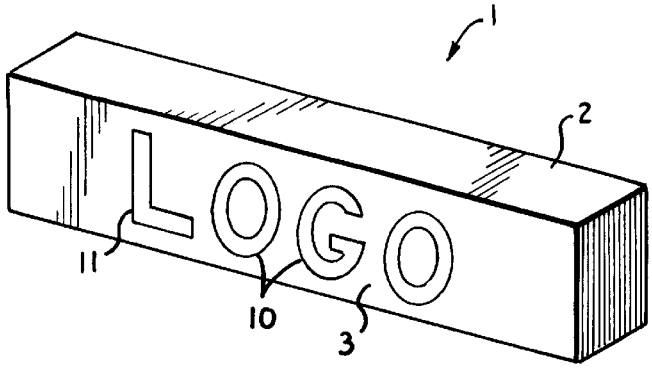
FIG. 1 is a perspective view of an electronic reminder device which embodies the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a reminder device which embodies the present invention. The apparatus 1 generally includes a housing 2 including a logo plate or lens 3 overlaid on an electronic display device or light source 4 (FIG. 4) and a timer or timer circuit 5. The timer circuit 5 is adapted to provide a display activation signal to the light source 4 after a set interval to illuminate or call attention to the logo plate 3, to thereby provide a reminder to use a product of a brand associated with the logo plate 3 or otherwise engage in some activity associated with a brand or entity identified on the logo plate 3.

The housing 2 may be formed of a plastic and of a size to contain circuitry 8 of the apparatus 1. In the embodiment shown, the logo plate 3 forms a front wall of the housing 2. Preferably, the logo plate 3 has logo indicia 10 (FIG. 1) formed thereon which is of such a nature as to have a different appearance when the display device 4 is activated. For example, the logo indicia 10 could be transparent regions of the logo plate 3. Alternatively, the logo indicia 10 may simply be imprinted on the plate 3 with portions of the plate 3 being either transparent or translucent, such that light emitted from the light source 4 is visible through the logo plate 3. The logo indicia 10 may be an actual trademark design or logo 11 or may be text letters forming a brand name of the product or service associated with the apparatus 1. In addition to a trademark, the logo indicia could be a trade name, service mark, collective membership mark, or the name of an entity such as a corporation, association or club relative to which some activity is to be performed or taken at a preset time period or interval. It is also forseen that a generic name for the product could be used in association with the logo.

Figure 4:
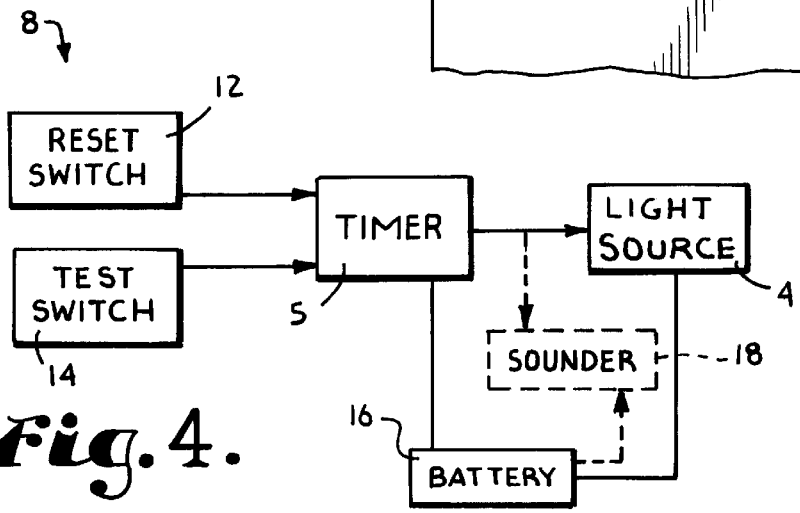
FIG. 4 is a simplified block diagram illustrating principal functional components of the electronic reminder device.

Referring to FIG. 4, the timer circuit 5 may be any of a number of digital counter/timer circuits which may be programmed to count a selected number of clocked cycles and to output a signal state when the target count is reached. The signal state persists until a reset switch 12 is operated, which re-initiates the timer circuit 5. The output signal state can be used to activate the display device 4, either directly or through an external driver (not shown). The timer circuit 5 may be preprogrammed for a timer cycle which is appropriate for the activity associated with the logo indicia 10. Alternatively, the timer circuit 5 may by adapted to be user programmable, with the provision of appropriate programming switches (not shown). The circuitry 8 may incorporate a test switch 14 which causes the timer circuit 5 to activate the display device 4 (i.e. activate the light source) until the reset switch 12 is operated or until a test interval times out. The circuitry 8 may also incorporate a sounder device 18 which is activated when the timer circuit 5 activates the display device 4. The sounder 18 may be a very low power type of sounder which produces chirping or clicking type sounds, such as are used on some types of personal digital assistants, PDA's.

The logo display device 4 may be one or more light emitting diodes (LED's), a plasma display, a liquid crystal display (LCD) or the like. Preferably, the display device 4 is a low power consumption device to preserve the life of a battery 16 which powers the timer circuit 5, the sounder 18 if present, and the display device 4. Although the display device 4 is shown as positioned behind the lens 3 and visible through the logo indicia 10, alternatively, it may be positioned adjacent the logo indicia 10. Either way, activation of the display device 4 calls visual attention to the logo indicia 10, to thereby remind the owner to utilize a product of a brand associated with the logo indicia 10.

Preferably, the battery 16 is a small, but efficient type of battery, such as certain types of lithium-ion batteries which are available in "button" sizes.

Figure 2:
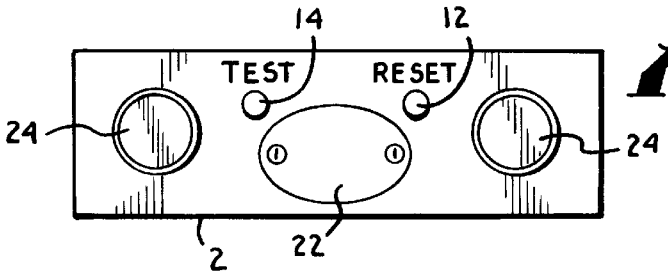
FIG. 2 is a rear elevational view of the electronic reminder device.
Figure 3:
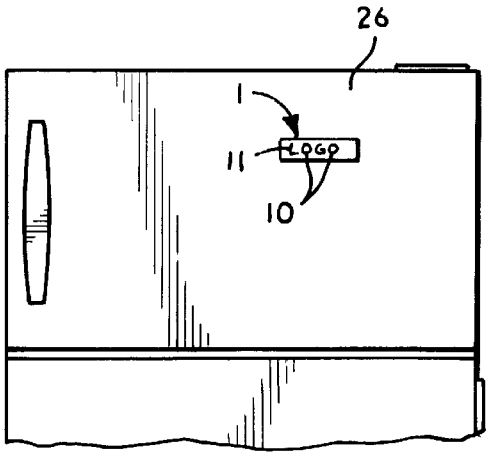
FIG. 3 is a front elevational view of the electronic reminder device at a greatly reduced scale, shown magnetically secured to a refrigerator.

Referring to FIG. 2, the circuitry 8 is positioned within the housing 2. The reset switch 12 and the test switch 14 are accessible on a rear wall 20 of the housing 2. A battery access panel 22 may also be provided on the rear wall, to replace the battery 16 as necessary. The apparatus 1 includes a mechanism for positioning it in a conspicuous location. The illustrated apparatus 1 includes one or more magnets 24 for magnetically securing the housing 2 in a convenient location, such as on a refrigerator 26 (FIG. 3) or other appliance, a metal cabinet of a kitchen, a computer case, or the like which is conspicuous to the user. Alternatively, the magnets 24 could be replaced by some other securing mechanism, such as a strip of hook and loop fastener, a double sided adhesive strip, a key ring, or the like.

The apparatus 1 is preferrably provided by the manufacturer of the product with which the logo 11 is associated with the timer circuit 5 preprogrammed for a timer cycle appropriate for the associated product. When the product is used for the first time, the reset switch 12 is operated to initiate operation of the timer circuit 5. The apparatus 1 is placed in a conspicuous location, such as on a refrigerator 26, using the magnets 24. The timer circuit 5 may be programmed so that the test switch 14 can be operated at any time without interrupting a timer cycle in progress. When the time cycle completes, the timer circuit 5 applies a display or illumination enable signal to the display device 4 to activate it and illuminate or otherwise call visual attention to the logo 11. A sounder 18 may also be activated. The display enable signal preferably persists until the reset switch 12 is again operated, at which time, the timer circuit 5 re-initiates the timer cycle.

Although the reminder apparatus 1 has been described with reference to administration of medications, it is not intended to be limited to such activity. The apparatus 1 may also be applied to any other activity which is associated with a manufacturer, organization, or other entity having a known brand or name. For example, an organization can have the apparatus 1 manufactured with their organization name applied as the logo 11 to remind a member of the organization to attend a bi-weekly or monthly meeting, or to pay their dues, or the like. Further, the reminder could be supplied by an entity which performs routine maintenance services, to remind the user when to contact the service provider the next time the service should be performed. For example, a business which performs automobile oil changes could provide a reminder device 1 with its logo 10 wherein the timer was programmed to activate the display device or light source 4 at the recommended interval for having an oil change (such as every three months).

It is also foreseen that the apparatus could be constructed without the timer or timer circuit, to instead provide a device which can be selectively activated to light up a logo and activate a sounder in response to pressing a button or upon detection of motion in past the apparatus or by other activation means now known or later developed.

It is to be understood that while certain forms of the present invention have been illustrated and described herein, it is not to be limited to the specific forms or arrangement of parts described and shown.

What is claimed and desired to secure by letters patent is:

1. An apparatus for reminding a person to engage in an activity associated with a particular brand and comprising:

(a) a housing;

(b) a lens connected to said housing and having logo indicia formed thereon which is associated with said particular brand;

(c) a light source secured within said housing behind said lens and activated by an illumination enable signal to illuminate said logo indicia; and (d) a timer coupled to said light source to provide said illumination enable signal after a selected interval of time.

2. The apparatus as set forth in claim 1 and including:

(a) a reset switch coupled to said timer and operable to cause said timer to initiate a timing cycle to thereby provide said illumination enable signal at said selected interval of time after initiation of said timing cycle.

3. The apparatus as set forth in claim 1 and including:

(a) a test switch coupled to said timer and operable to cause said timer to provide said illumination enable signal for at least a selected test interval to demonstrate operability of said apparatus.

4. The apparatus as set forth in claim 1 and including:

(a) a mounting device positioned on said housing and enabling said apparatus to be secured at a selected conspicuous location.

5. The apparatus as set forth in claim 1 and including:

(a) a magnet secured to said housing and enabling said apparatus to be magnetically secured at a selected conspicuous location.

6. The apparatus as set forth in claim 1 and including:

(a) a sounder device positioned in said housing, coupled to said timer, and being activated by said timer upon said timer providing said illumination enable signal to provide an audible signal to thereby attract attention to said apparatus.

7. An apparatus for reminding a customer to utilize a particular brand of a product and comprising:

(a) a housing;

(b) a lens connected to said housing and having logo indicia formed thereon which is associated with said particular brand;

(c) a light source secured within said housing and activated by an illumination enable signal to illuminate said logo indicia; and (d) a timer coupled to said light source to provide said illumination enable signal after a selected interval of time.

8. The apparatus as set forth in claim 7 and including:

(a) a reset switch coupled to said timer and operable to cause said timer to initiate a timing cycle to thereby provide said illumination enable signal at said selected interval of time after initiation of said timing cycle.

9. The apparatus as set forth in claim 7 and including:

(a) a test switch coupled to said timer and operable to cause said timer to provide said illumination enable signal for at least a selected test interval to demonstrate operability of said apparatus.

10. The apparatus as set forth in claim 7 and including:

(a) a mounting device positioned on said housing and enabling said apparatus to be secured at a selected conspicuous location.

11. The apparatus as set forth in claim 7 and including:

(a) a magnet secured to said housing and enabling said apparatus to be magnetically secured at a selected conspicuous location.

12. The apparatus as set forth in claim 7 and including:

(a) a sounder device positioned in said housing, coupled to said timer, and being activated by said timer upon said timer providing said illumination enable signal to provide an audible signal to thereby attract attention to said apparatus.

* * * * *